United States Patent [19]

Jackson

[11] Patent Number: 4,688,732

[45] Date of Patent: Aug. 25, 1987

[54] REFINER WITH IMPROVED BEARING RETAINER CONSTRUCTION

[75] Inventor: Gary L. Jackson, Springfield, Ohio

[73] Assignee: The Bauer Bros. Co., Springfield, Ohio

[21] Appl. No.: 896,800

[22] Filed: Aug. 15, 1986

[51] Int. Cl.[4] ..... B02C 7/14

[52] U.S. Cl. ..... 241/251; 241/259; 241/259.1; 241/285 R; 241/286

[58] Field of Search ..... 241/259, 259.1, 259.2, 241/259.3, 285 R, 286, 290, 251

[56] References Cited

U.S. PATENT DOCUMENTS 3,038,673 6/1962 Fisher ..... 241/259.1 X 3,371,873 3/1968 Thomas ..... 241/259.1 X

*Primary Examiner*—Timothy V. Eley

*Attorney, Agent, or Firm*—William W. Habelt

[57] ABSTRACT

A bearing assembly (40) is provided for supporting a rotatable and axially displaceable shaft (16) of a disc-type refining apparatus (10). An annular retainer ring (44) is mounted non-rotatably about the outer annular ring (54) of a bearing means (42) and has an outer circumferential surface (45) having a plurality of axially elongated pads (60) mounted thereto extending parallel to the shaft (16) at circumferentially spaced intervals about the outer surface (45) of the retainer ring (44). The bearing housing (46) has an inner circumferential surface (47) spaced from the outer circumferential surface (45) of the retainer ring (44) and has a plurality of axially elongated pads (70) mounted thereto extending parallel to the shaft (16) at circumferentially spaced intervals about the inner surface (47) of the bearing housing (46). The plurality of pads (70) mounted to the inner surface (47) of the bearing housing (46) is equal in number to the plurality of pads (60) mounted to the outer surface (45) of the retainer ring (44). Each of the pads (70) disposed about the inner surface of the bearing housing mate with and contact a pad (60) mounted to the outer surface of the retainer ring. The innerfaces therebetween provide sliding surfaces along which the shaft (16) may be axially translated relative to the stationary bearing housing (46).

4 Claims, 3 Drawing Figures

REFINER WITH IMPROVED BEARING RETAINER CONSTRUCTION

BACKGROUND OF THE INVENTION

The present invention relates to grinding apparatus for defiberating cellulosic material in the space between two opposed, relatively rotating grinding disks. More particularly, this invention relates to an improved bearing assembly for mounting about the rotating shaft such a grinding apparatus.

Such grinding apparatus, typically termed refiners, may be used to defiberize or disintegrate various cellulosic materials. However, one very common use of such refiners is to mechanically defiberize wood chips to produce pulp for use in making paper. Although this treatment may be carried out in a number of different ways, the refining process generally involves separating and cutting the fibers of the wood chips by passing the wood chips between spaced grinding surfaces commonly referred to as discs. More particularly, two parallel discs are disposed in spaced relationship and rotate one relative to the other. The surface of the discs have refiner plates mounted thereto which provide a surface for acting upon the wood chips in the gap defined therebetween.

In the refining process, it is often necessary to optimize the process by adjusting the gap between the refiner plates in response to changes in the nature of the wood chips being processed, the consistency of the pulp slurry forming between the plates, the operating load on the refiner, and other known factors. Additionally, it is sometimes necessary to adjust the spacing between the plates in order to avoid undesirable contact between the plate surfaces known as plate clashing. Such plate clashing can destroy the surface configuration of the plates which typically are designed with a specific and concise configuration of grooves and bars.

In order to adjust the gap between the opposed plate surfaces, it is customary to axially displace one of the grinding discs with respect to the other. This typically involves axially translating the entire shaft together with the discs mounted thereto within its housing. Of necessity, the bearing supporting the shaft must also translate with the shaft within the housing. Therefore, it is necessary to design the bearing assembly such that axial movement is permitted between the bearing retainer ring and the bearing housing structure. In typical prior art bearing assemblies, the bearing retainer ring is typically held in place within the bearing housing by a cylindrical loose fit and key/keyway-type structure to prevent rotation. An axially elongated key is mounted to extend outwardly from the retainer ring and loosely mate into a corresponding keyway formed in the bearing housing structure. A loose fit must be provided between the retainer and the bearing housing and in key to keyway mounting so as to permit axial translation of the retainer ring as the shaft is moved within the housing. Unfortunately, the requirement for such a loose fit reduces the horizontal stiffness of the structure making it difficult to control shaft vibration which in turn can result in wear between the mating parts necessitating shutdown of the machinery for the replacement of prematurely worn parts.

SUMMARY OF THE INVENTION

It is an object of the present invention to provide a bearing assembly incorporating an improved means for retaining the bearing within the bearing housing while permitting axial translation of the bearing retainer ring with respect to the bearing housing.

It is an additional object of the present invention to provide such a retaining means wherein the horizontal stiffness of the bearing assembly is improved thereby enhancing the ability to control vibration.

Accordingly, a bearing assembly is provided for supporting a rotatable and axially displaceable shaft, such as the shaft of a disc-type refining apparatus, comprising a bearing race, an annular retainer ring non-rotatably mounted about the bearing race, and bearing housing means disposed in space relationship about the retainer ring for supporting the bearing assembly. The annular retainer ring is mounted non-rotatably about the outer annular ring of the bearing race and has an outer circumferential surface having a plurality of axially elongated pads mounted thereto extending parallel to the shaft at circumferentially spaced intervals about the outer surface of the retainer ring. The bearing housing has an inner circumferential surface spaced from the outer circumferential surface of the retainer ring and has a plurality of axially elongated pads mounted thereto extending parallel to the shaft at circumferentially spaced intervals about the inner surface of the bearing housing. The plurality of pads mounted to the inner surface of the bearing housing is equal in number to the plurality of pads mounted to the outer surface of the retainer ring. Each of the pads disposed about the inner surface of the bearing housing mate with and contact a pad mounted to the outer surface of the retainer ring. The innerface therebetween provides a surface along which the shaft may be axially translated relative to the stationary bearing housing.

DESCRIPTION OF THE PREFERRED EMBODIMENT

Figure 1:
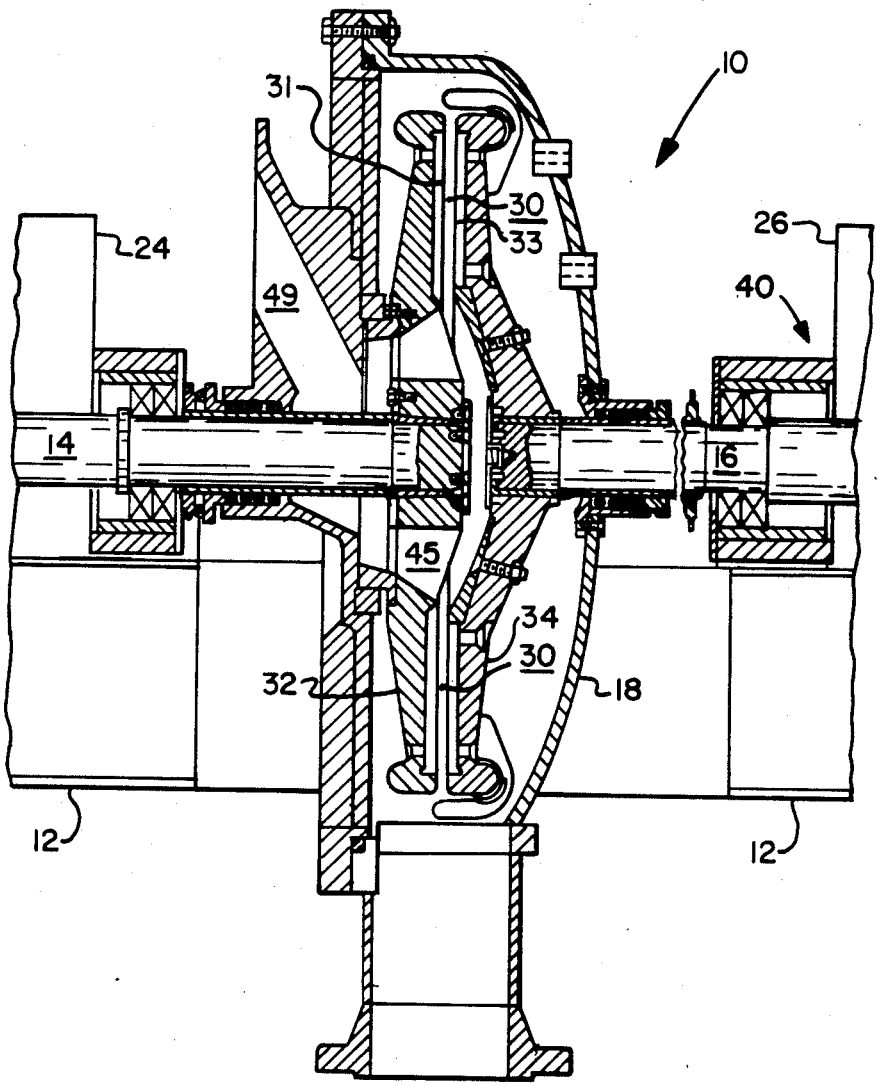
FIG. 1 is a longitudinal sectional, partly diagrammatic, view of a rotating double disc refiner incorporating the bearing means of the present invention.

Referring now to FIG. 1, there is depicted therein a refining apparatus 10 having a support base 12 and first and second relatively rotating refining members mounted on independent shafts 14 and 16 operatively coupled respectively with longitudinally spaced motors 24 and 26. The shafts are disposed in an aligned opposing relationship with their inner ends disposed adjacent to one another within the refiner casing 18. Mounted to the inner end of the shaft 14 is a first refining member 32. In an opposed spaced relationship to the refining member 32 is a like member 34 secured to the inner end of the opposing shaft 16. The grinding members, commonly referred to as discs, rotate relative to each other. That is, at least one of the discs is mounted to a rotatable shaft while the other may be mounted either stationary or to a rotating shaft. In the embodiment shown in the drawing, both shaft 14 and shaft 16 rotate relative to each other with one shaft rotating in a counter-clockwise direction and the other shaft rotating in a clockwise direction. This type of refiner is commonly known as a rotating double disc refiner.

In operation of the refiner, fibrous material to be refined is fed between the refining surfaces 31,33 of the opposed grinding discs 32,34 through chute 49 and inlet 45 to pass radially outward through the gap 30 between the relatively rotating disc. Typically, the discs are spaced from each other so as to provide a 0.04 to 0.10 inches gap therebetween depending upon the particular application and material being refined. Although, it is to be understood that the invention is no way limited by the spacing between the gaps which may be as little as 0.01 inches in certain applications. Accordingly, it is desirable to design such a refiner apparatus that the gap between the plates is adjustable by axially translating at least one of the rotating axis together with the disc mounted thereto.

In the apparatus illustrated in the drawing, the rotating shaft 16 is also axially translatable and is mounted on a bearing housing 40 designed in accordance with the present invention to facilitate axial translation of the rotating shaft 16 so as to adjust the gap 30 between the refining surfaces 31,33 of the opposed refining discs 32 and 34. To adjust the gap between the refining surfaces of the opposed refining discs, the disc 34, the shaft 16 and the motor 25 to which it is operatively coupled would all translate axially away from or toward the opposed stationary disc 32 with the shaft 16 translating relative to the stationary bearing housing while remaining completely supported for rotation by the bearings within the housing.

Figure 2:
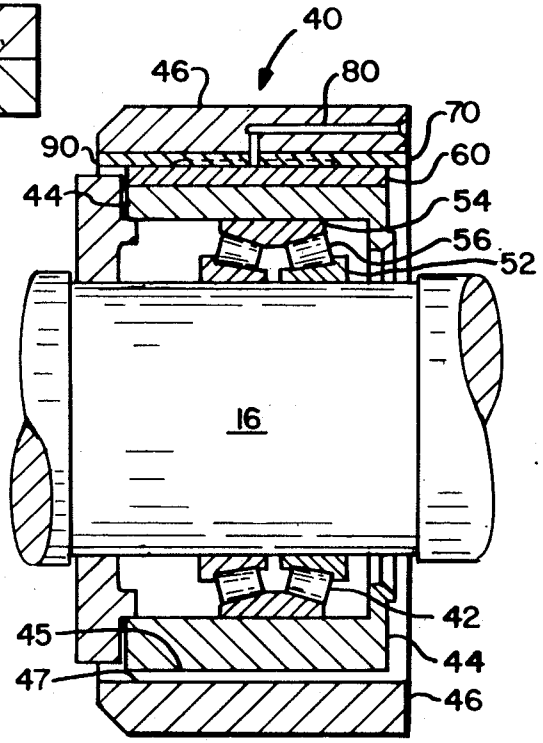
FIG. 2 is a enlarged sectional view of the bearing means of the present invention mounted about the axially displaceable shaft of the refiner of FIG. 1.
Figure 3:
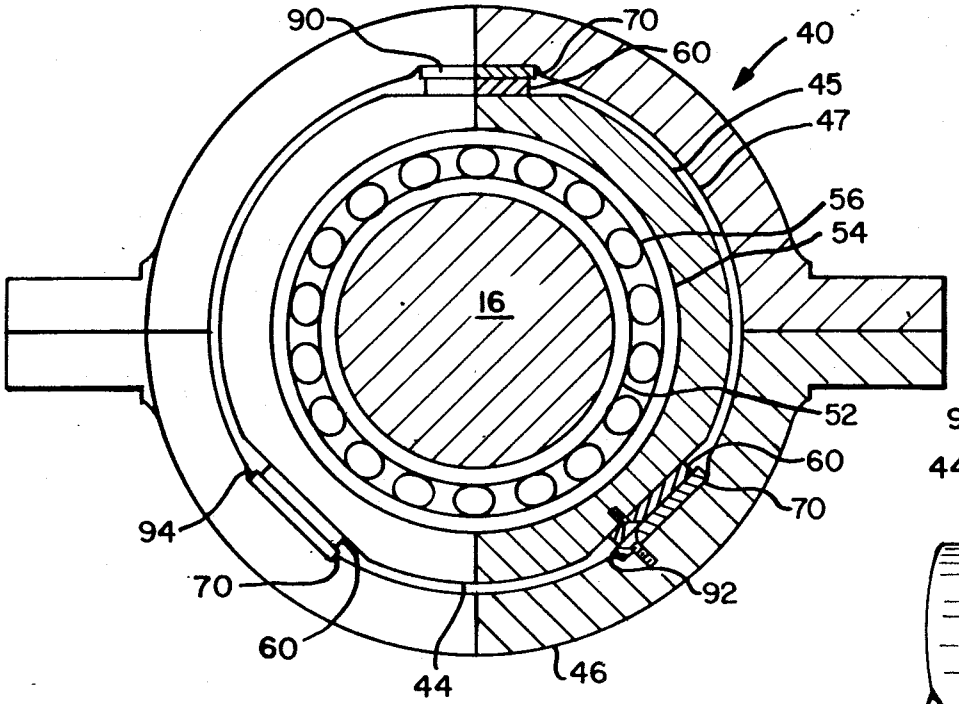
FIG. 3 is a cross-sectional view taken along line 3—3 of FIG. 2.

As best seen in FIGS. 2 and 3, the bearing assembly 40 comprises anti-friction bearing means 42, an annular retainer ring 44 mounted about the anti-friction bearing means 42, and a bearing housing means 46 disposed in spaced relationship about the retainer ring 44 for supporting the bearing housing from the support base 12 of the refining apparatus. The anti-friction bearing means 42 is of a conventional design having an inner annular ring 52 non-rotatably mounted about the first shaft 16, an outer annular ring 54 disposed in spaced relationship about the inner annular ring and bearing means 56 disposed therebetween.

The annular retainer ring 44 is non-rotatably mounted about the outer annular ring 54 of the bearing means 42. The retainer ring 44 has an outer circumferential surface 45 having a plurality of axially elongated pads 60 mounted thereto extending parallel to the axis of the first shaft 16 at circumferentially spaced intervals about the outer surface 45 of the retainer ring 44. The bearing housing means 46 disposed in spaced relationship about the retainer ring 44 has an inner circumferential surface 47 which is disposed in radially spaced relationship from the outer circumferential surface 45 of the retainer ring 44 and has a plurality of axially elongated pads 70 mounted thereto so as to extend parallel to the axis of the first shaft 16 at circumferentially spaced intervals about the inner surface 47 of the bearing housing 46.

The plurality of pads 70 mounted to the inner surface 47 of the bearing housing 46 is equal in number to the plurality of pads 60 mounted to the outer circumferential surface 45 of the retainer ring 44. Each of the individual pads 70 mounted to the inner surface 47 of the bearing housing means 46 mates with and contacts a corresponding member of the plurality of pads 60 mounted to the outer circumferential surface 45 for the retainer ring 44 whereby the innerfaces therebetween provide sliding support surfaces along which the first shaft 16 may be axially translated relative to the stationary bearing housing means 46.

To further facilitate axial translation of the shaft 16 within the bearing assembly, lubrication means 80 are provided in the bearing housing means 46 to provide a conduit extending through the bearing housing to open to the innerface between the plurality of pads 60 mounted to the outer circumferential surface 45 of the retainer ring 44 and the plurality of pads 70 mounted to the inner surface 47 of the bearing housing means 46 for supplying lubricating material to the innerface.

As best seen in FIG. 3, a particularly advantageous embodiment of the present invention utilizes three sets of mating pads 90,92,94 mounted in circumferentially spaced relationship between the outer surface 45 of the retainer ring 44 and the inner surface 47 of the bearing housing 46. A first set 90 of the mating pads 60,70 is disposed top-dead center above the shaft 16, a second set 92 of the mating pads 60,70 are disposed clockwise to the first set 90 of the mating pads by a first subtended angle, preferably of 135 degrees, and a third set 94 of the mating pads 60,70 is disposed counter-clockwise of the first set 90 of the mating pads by a second subtended angle, being equal to the first subtended angle. This preferred "V-block" arrangement of the mating pads substantially increases the horizontal stiffness of the shaft and bearing assembly arrangement by providing support in both the horizontal and vertical directions at pad sets 92 and 94. The clearance present in the prior art bearing assemblies, which permits horizontal movement of the shaft resulting in adverse and undesirable vibration, is eliminated.

To further facilitate the axial translation of the shaft 16 within the stationary bearing housing 46, at least one pad of each of the mated pairs can be coated with a low-friction material to decrease friction forces during translation of the shaft along the innerfaces between the mated pads. Although the pads themselves may be made of any number of materials compatible with the bearing housing or the retainer ring to which they are mounted, it is presently contemplated that the pads 70 mounted to the inner circumferential surface 47 of the bearing housing means 46 would be made of chrome plated steel while the pads 60 mounted to the outer circumferential surface 45 of the retainer ring 44 in mating relationship with the pad 70 would be produced of steel having a teflon coating on their outer surface which will contact the mating pad 70.

I claim:

1. A refining apparatus having a support base, first and second relatively rotating refining members disposed in spaced relationship with the refinery surfaces of each of the first and second refining members facing one another to form a gap therebetween in which material to be refined is refined, an axially displaceable rotatable first shaft to which the first refining member is mounted, means for rotating the first shaft, and a bearing assembly supporting the first shaft for rotation and axial displacement, said bearing assembly comprising:

a. a bearing means having an inner annular ring non-rotatably mounted about the first shaft, an outer annular ring disposed about the inner annular ring, and bearings disposed therebetween;

b. an annular retainer ring non-rotatably mounted about the outer annular ring of the bearing means, said retainer ring having an outer circumferential surface having a plurality of axially elongated pads mounted thereto extending parallel to the first shaft at circumferentially spaced intervals about the outer surface of said retainer ring; and c. bearing housing means disposed in spaced relationship about said retainer ring for supporting said bearing assembly from the support base of said refining apparatus, said bearing housing having an inner circumferential surface spaced from the outer circumferential surface of said retainer ring and having a plurality of axially elongated pads mounted thereto extending parallel to the first shaft at circumferentially spaced intervals about the inner surface of said bearing housing, the plurality of pads mounted to the inner surface of said bearing housing equal in number to the plurality of pads mounted to the outer surface of said retainer ring and being disposed about the inner surface of said bearing housing such that each of the plurality of pads mounted thereto mates with and contacts one of the plurality of the pads mounted to the outer surface of the retainer ring whereby the interfaces therebetween provide sliding surfaces along which the first shaft may be axially translated relative to the stationary bearing housing means.

2. A refining apparatus as recited in claim 1 further comprising lubrication means extending through said bearing housing to open to the interfaces between the plurality of the pads mounted to the outer surface of the retainer ring and the plurality of the pads mounted to the inner surface of the bearing housing for supplying lubricating material to the interface.

3. A refining apparatus as recited in claim 1 wherein three pads are mounted in circumferentially spaced relationship about the outer surface of said retainer ring in mating relationship with three pads mounted in circumferentially spaced relationship about the inner surface of said bearing housing to form three sets of mating pads providing the surfaces along which the first shaft may be axially translated through the bearing housing, a first set of said mating pads disposed top-dead center above the first shaft, a second set of said mating pads by a first subtended angle, and a third set of said mating pads disposed counter-clockwise of the first set of mating pads by a second subtended angle, said first and second subtended angles being equal.

4. A refining apparatus as recited in claim 3 wherein said first and second subtended angles subtend an angle of approximately 135 degrees.

* * * * *